United States Patent [19]

Shimogori et al.

[11] Patent Number: 4,634,478

[45] Date of Patent: Jan. 6, 1987

[54] TITANIUM MOLYBDENUM ALLOY SUPERIOR IN RESISTANCE TO PITTING CORROSION IN BROMIDE ION ENVIRONMENT

[75] Inventors: Kazutoshi Shimogori, Kobe; Hiroshi Satoh, Sumiyoshimiya; Fumio Kamikubo, Kobe, all of Japan

[73] Assignee: Kabushiki Kaisha Kobe Seiko Sho, Kobe, Japan

[21] Appl. No.: 764,745

[22] Filed: Aug. 12, 1985

[30] Foreign Application Priority Data

Aug. 13, 1984 [JP] Japan ..... 59-169736

[51] Int. Cl.[4] ..... C22C 14/00

[52] U.S. Cl. ..... 148/421; 420/421

[58] Field of Search ..... 420/421; 148/421; 420/417

[56] References Cited

U.S. PATENT DOCUMENTS 2,614,041 10/1952 Finlay ..... 420/421

FOREIGN PATENT DOCUMENTS 55-6472 1/1980 Japan ..... 420/421

882184 11/1961 United Kingdom ..... 420/421

OTHER PUBLICATIONS

D. J. DeLazaro et al, J. Metals, Mar. 1952, pp. 265–269.

*Primary Examiner*—L. Dewayne Rutledge

*Assistant Examiner*—Robert L. McDowell

*Attorney, Agent, or Firm*—Oblon, Fisher, Spivak, McClelland & Maier

[57] ABSTRACT

There is provided a Ti-Mo alloy containing 0.2 to 3.0 wt % of molybdenum, with the balance being substantially titanium, characterized in that the amount of Fe in the impurities is not greater than 0.1% and the amount of $O_2$ in the impurities is in the range that satisfies the following equation on the basis of the amount of Mo (%).

$$O_2\,(\%) \leqq 9/35 - 1/28 \cdot Mo\,(\%)$$

said titanium alloy being highly resistant to pitting corrosion in an environment where there are bromide ions and being superior in formability. Said alloy undergoes heating at a temperature higher than 700° C. and lower than the α-transformation point and then cooling at a rate of 500° C./min or less, whereby said alloy is rendered malleable.

1 Claim, 6 Drawing Figures

TITANIUM MOLYBDENUM ALLOY SUPERIOR IN RESISTANCE TO PITTING CORROSION IN BROMIDE ION ENVIRONMENT

BACKGROUND OF THE INVENTION

1. Field of the Invention

The present invention relates to a Ti-Mo alloy which exhibits outstanding resistance to pitting corrosion in an environment of high temperature and high pressure where there are bromide ions. The Ti-Mo alloy has good formability which is indispensable for materials constituting the chemical machines and equipment.

2. Description of the Prior Art

Titanium is superior in corrosion resistance, particularly in an environment where there are halogen ions. Because of this property, titanium has come into general use as a material for the process equipment which is exposed to such an environment. Nowadays titanium and titanium alloys are very important materials which support the entire industry. There are not any other materials than them that can be used in a severe environment where even stainless steel as the commonest anti-corrosion material is useless.

Nevertheless, the corrosion resistance of titanium is not always complete under any circumstances. It is often pointed out that titanium involves some problems in its corrosion resistance, due partly to the fact that titanium is used in environments under especially severe corrosive conditions.

What attracts more attention to the corrosion of titanium is localized corrosion that occurs and propagates locally rather than general corrosion that occurs all over the surface. What attracts special attention is crevice corrosion in an environment, particularly that of high temperature, where there are chloride ions. The next important problem is pitting corrosion in an environment where there are bromide ions. An example is the accident resulting from pitting corrosion in a high-temperature high-pressure reactor for the reaction catalyzed by a bromide.

Crevice corrosion occurs when a very narrow crevice is formed on the metal surface, whereas pitting corrosion does not necessarily require the presence of a crevice for its occurrence. Pitting corrosion occurs so locally that a penetrating hole may appear on the surface which is almost completely intact (say, more than 99%). Therefore, the occurrence of pitting corrosion is often overlooked, which leads to a sudden accident that takes place before an adequate measure is taken. It is fully recognized that it is very important to establish the means to prevent pitting corrosion. However, any means effective in preventing crevice corrosion cannot be used for the prevention of pitting corrosion because the two types of corrosion differ from each other in the mechanism of occurrence. Thus the development of a unique effective means is required.

The prevention of pitting corrosion may be achieved in two ways—the operation and control of the equipment and the improvement of the material itself. The first way is intended to make mild the operation conditions. There is naturally a limitation in doing so because it sacrifices the efficiency of the chemical process. The actual trend is rather contrary. The recent chemical process is performed under more severe conditions for corrosion than before. Such conditions often prevent the use of titanium. Under such conditions, an inhibitor may be added for the prevention of pitting corrosion.

Anions such as sulfate, nitrate, and phosphate ions are effective as an inhibitor. The use of an inhibitor is not recommended freely because it contaminates the process and lowers the reaction yields.

The improvement of the material, mentioned above as the second way, is disclosed in Japanese Patent Laid-open No. 39785/1983 entitled "Method for treating the titanium surface with nitric acid", proposed by the present inventors. According to this method, the corrosion preventive treatment is carried out before the equipment is put to operation. The advantage of this method is that the process solution is not contaminated and the resistance to pitting corrosion is not affected by the kind of halogen ions. However, the use of a large amount of nitric acid (especially hot nitric acid) imposes some restrictions on this method in practical use. (The treatment is performed before or after the fabrication of the materials.)

It is thought that the pitting corrosion on titanium by halogen ions is initiated by the local anodic breakdown of the passive film formed on titanium, as will be described in detail later. Thus, the resistance of titanium to pitting corrosion should be evaluated by the breakdown voltage of the passive film. And it is considered that the higher the breakdown voltage, the greater the resistance to pitting corrosion. The breakdown voltage may be called the pitting potential (critical potential for occurrence of pitting corrosion).

It is known that the pitting potential can be increased when titanium is made into a nickel-containing titanium alloy. This holds true where the halogen ions are chloride ions. [See Desalination 3 269–279 (1967).] However, the present inventors found that the pitting potential of a nickel-containing titanium alloy is not so high as expected in an environment where there are bromide ions.

It was found that chloride ions and bromide ions behave entirely differently in pitting corrosion of a nickel-containing titanium alloy, although they are of the same category of halogen ions. In an attempt to develop a new alloy which resists pitting corrosion in an environment of bromide ions, the present inventors investigated how chloride ions and bromide ions differently affect the mechanism by which pitting corrosion occurs. They also investigated by using different alloys how the alloying element affects the prevention of pitting corrosion in an environment where there are chloride ions or bromide ions.

The present inventors investigated the formability of the alloy which is an important property to be considered when the alloy is used as the constituting material of the industrial chemical machines and equipment. They established the adequate quantities of Fe and $O_2$ as impurities and the adequate conditions for annealing to render the alloy malleable.

SUMMARY OF THE INVENTION

Accordingly, it is an object of this invention to provide a titanium alloy which is highly resistant to pitting corrosion in an environment where there are bromide ions and which is superior in formability. According to this invention, there is provided a Ti-Mo alloy containing 0.2 to 3.0 wt% of molybdenum, with the balance being substantially titanium, characterized in that the amount of Fe in the impurities is not greater than 0.1% and the amount of $O_2$ in the impurities is in the range that satisfies the following equation on the basis of the amount of Mo (%).

$$O_2\,(\%) \leqq 9/35 - 1/28 \cdot Mo\,(\%)$$

This alloy is made malleable by heating at a temperature higher than 700° C. and lower than the $\beta$-transformation point and then cooling at a rate of 500° C./min or less.

DETAILED DESCRIPTION OF THE INVENTION

In an environment where there are halogen ions, the pitting corrosion on titanium occurs and propagates when the passive film, which is to protect titanium from corrosion, is locally broken and the bare titanium is exposed. The breaking of the passive film occurs when anodic polarization is induced by the oxidative power of the environment, and subsequently corrosion propagates at the point of anodic breaking.

Figure 6:
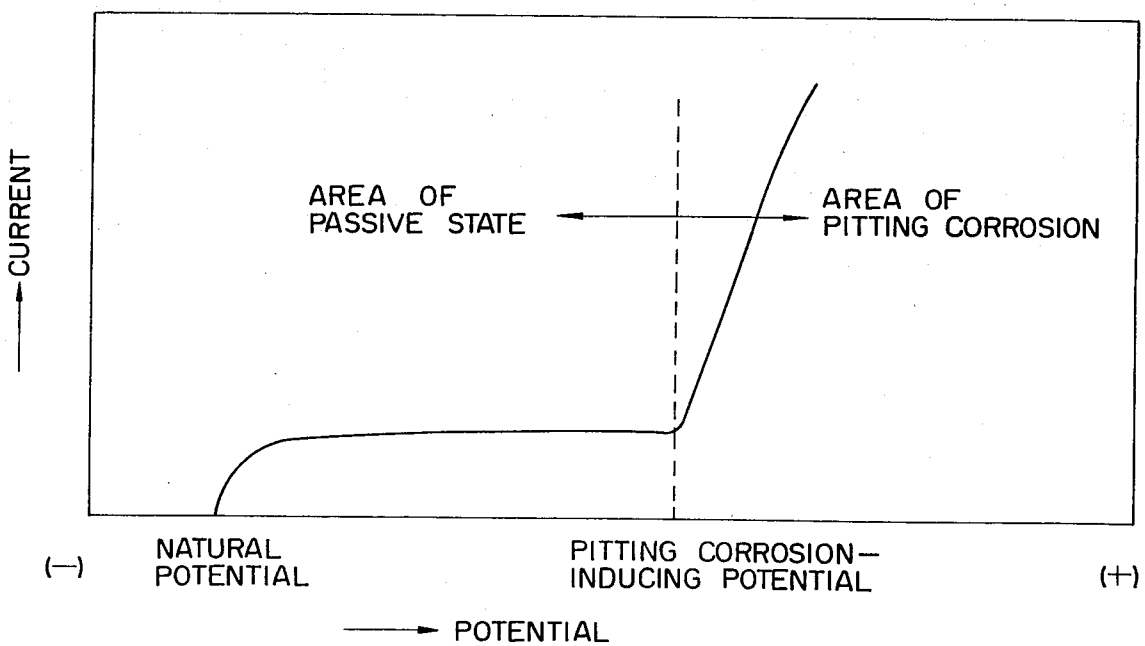
FIG. 6 is a schematic representation of the anodic polarization curve.

In order to visualize how pitting corrosion takes place, the present inventors established a model by using a schematic anodic polarization curve according to the electrochemical corrosion theory (FIG. 6). It is noted from this model that as the potential is increased toward plus from the natural potential (immersion corrosion potential), it reaches a point at which the current sharply increases. This critical potential can be defined as the pitting potential which is determined by the combination of the material in question and the the environmental factor. Below the pitting potential, the passive film remains intact and the occurrence of pitting corrosion is prevented. On the other hand, above the pitting potential, the passive film is broken, and consequently pitting corrosion takes place. In other words, the pitting potential which is determined under a given environmental condition is the most useful parameter with which to evaluate the resistance to pitting corrosion, and as the pitting potential increases, the resistance to pitting corrosion improves.

On the basis of the above discussion, the present inventors prepared titanium alloy samples and immersed them in an aqueous solution containing bromide ions at a high temperature under a high pressure, thereby to measure the pitting potential of respective alloy samples. It was found that molybdenum-containing titanium alloys have a particularly high pitting potential. According to this invention, the lower limit of the molybdenum content is 0.2 wt%. Below this limit, the alloy is poor in resistant to pitting corrosion. The upper limit of the molybdenum content is 3.0 wt%. Above this limit, the resistance to pitting corrosion levels off, although it increases with the content of molybdenum. In addition, molybdenum in excess of 3.0 wt% is not desirable for formability and economy. The present inventors believe that the maximum effect of preventing pitting corrosion is produced when molybdenum is concentrated in the passive film or a very small amount of molybdenum ions that has dissolved is concentrated in the vicinity of the surface.

The above-mentioned effect is characteristic of molybdenum, and nickel which prevents pitting corrosion from occurring in an environment of chloride ions is completely ineffective in an environment of bromide ions. The following is the speculation about the difference between chloride ions and bromide ions and the difference between nickel and molybdenum.

The pitting potential in bromide ions is considerably lower than that in chloride ions, and the passive film is liable to breaking accordingly in bromide ions. In the case of pitting corrosion in bromide ions, the important factor is not only the properties (structure and composition) of the passive film, but also the site that forms the nucleus for pitting corrosion as the result of discharge by the concentration of bromide ions. On the other hand, in the case of pitting corrosion in chloride ions, the passive film is broken after it has grown. Therefore, the property of the film is a predominant factor and the nucleus-forming site is not so influential.

The site to form the nucleus of pitting corrosion is predominantly affected by the intermetallic compound of titanium; therefore, nickel and cobalt which are eutectic alloy elements are liable to provide the site to form the nucleus of pitting corrosion. This property offsets their effect of improving the property of the passive film, with the result that they do not improve the resistance to pitting corrosion. In contrast, molybdenum is a solid solution-forming element and does not provide the nucleus-forming site. It follows, therefore, that its effect of improving the property of the passive film remains unaffected. In the case of vanadium or tungsten, which are also solid solution-forming elements, the effect of preventing pitting corrosion is not so remarkable. The reason for this is that the element exhibits its characteristic property in the adsorption of bromide ions and the suppression of discharge. Among several solid solution-forming elements, only molybdenum has its characteristic ability to prevent pitting corrosion in an environment of bromide ions. This finding is quite surprising.

The titanium alloy of this invention contains 0.2 to 3.0 wt% of molybdenum as mentioned above. Despite its small amount, molybdenum increases the strength of the alloy and slightly decreases the ductility of the alloy. To compensate a loss in ductility and to impart formability to the alloy to be used as a material for industrial equipment, the alloy is incorporated with a proper amount of Fe and $O_2$ as impurity elements.

It was found that the flexural strength of the titanium alloy (Mo: 0.2 to 3.0 wt%) decreases when the Fe content exceeds 0.1%, regardless of the Mo content. This indicates that the ductility satisfactory for practical use will be attained if the Fe content is less than 0.1%. The present inventors believe that the limitation of the Fe content is associated with the precipitation of an intermetallic compound TiFe.

The same experiments as mentioned above were carried out with alloys containing different amounts of $O_2$.

As the result, it was found that there is a relationship between the upper limit of $O_2$ content and the amount of Mo. In other words, as the amount of Mo increases, the upper limit of $O_2$ content should be decreased according to the following equation.

$$O_2(\%) \leqq 9/35 - 1/28 \cdot Mo(\%)$$

The relationship between the amount of $O_2$ and the amount of Mo is not fully elucidated yet. The present inventors believe that $O_2$ stabilizes the $\alpha$-phase (hexagonal closed packing lattice) and Mo stabilizes the $\beta$-phase (body-centered cubic lattice) and they act on each other.

The titanium alloy of this invention having the above-mentioned composition would not have satisfactory formability unless it undergoes annealing under an adequate condition. That is, the heating temperature should be higher than 700° C. and lower than the $\beta$-transformation point, and the cooling rate should be lower than 500° C./min.

With the heating temperature below 700° C., the annealing effect is not satisfactory; and with the heating temperature above the $\beta$-transformation point, the resulting alloy is poor in formability. (The $\beta$-transformation point is a temperature at which transformation from the $\alpha+\beta$ dual phase to the $\beta$ single phase takes place. This temperature slightly varies depending on the amount of Mo in the alloy. If the alloy is heated above this temperature and then cooled, the alloy does not have the uniform $\alpha+\beta$ structure, but contains the needle-like $\alpha$-phase and unstable $\beta$-phase. This is the cause of poor formability.)

The cooling rate greater than 500° C./min impairs the formability because the Mo-containing alloy is capable of quenching.

The invention is now described in more detail with reference to the following examples.

EXAMPLE 1

Molybdenum-containing titanium alloys (with the Mo content varying from 0 to 8 wt%) were produced from sponge titanium, titanium powder, and molybdenum powder by using a vacuum arc furnace. The resulting ingot underwent hot forging, hot rolling, cold rolling, and annealing, to give a 2 mm thick alloy plate. This plate was cut into square plates, each measuring 20 mm by 20 mm. The square plate was made into an electrode by attaching a titanium lead wire by spot welding. (This electrode was used to measure the pitting potential or to obtain the anodic polarization curve.)

The electrode was immersed in an aqueous solution containing 1% of bromide ions (in terms of NaBr) held in an autoclave for electrochemical testing. The pitting potential was measured at 140° C. and 200° C. The counter electrode was a platinum plate, the reference electrode was an external Ag/AgCl electrode, and the potential was measured according to the potential scanning method with an automatic controlled-potential electrolysis apparatus. The results are shown in Table 1.

TABLE 1

| Results of measurement of pitting potential | | | |
|---|---|---|---|
| No. | Content of Mo (wt %) | Pitting potential (V vs Ag/AgCl) at 140° C. | Pitting potential (V vs Ag/AgCl) at 200° C. |
| 1 | 0 | +0.86 | +0.62 |

TABLE 1-continued

| Results of measurement of pitting potential | | | |
|---|---|---|---|
| No. | Content of Mo (wt %) | Pitting potential (V vs Ag/AgCl) at 140° C. | Pitting potential (V vs Ag/AgCl) at 200° C. |
| 2 | 0.05 | +0.89 | +0.70 |
| 3 | 0.1 | +0.94 | +0.72 |
| 4 | 0.15 | +0.97 | +0.79 |
| 5 | 0.2 | +1.15 | +0.98 |
| 6 | 0.5 | +1.16 | +1.01 |
| 7 | 1.0 | +1.21 | +1.01 |
| 8 | 2.0 | +1.22 | +1.03 |
| 9 | 3.0 | +1.25 | +1.04 |
| 10 | 4.0 | +1.28 | +1.05 |
| 11 | 5.0 | +1.28 | +1.07 |
| 12 | 8.0 | +1.31 | +1.07 |

It is noted from Table 1 that when the Mo content exceeds 0.2 wt%, the pitting potential suddenly increases and the anti-pitting-corrosion effect becomes remarkable, and the effect levels off as the Mo content exceeds 3 wt%.

EXAMPLE 2

Figure 1:
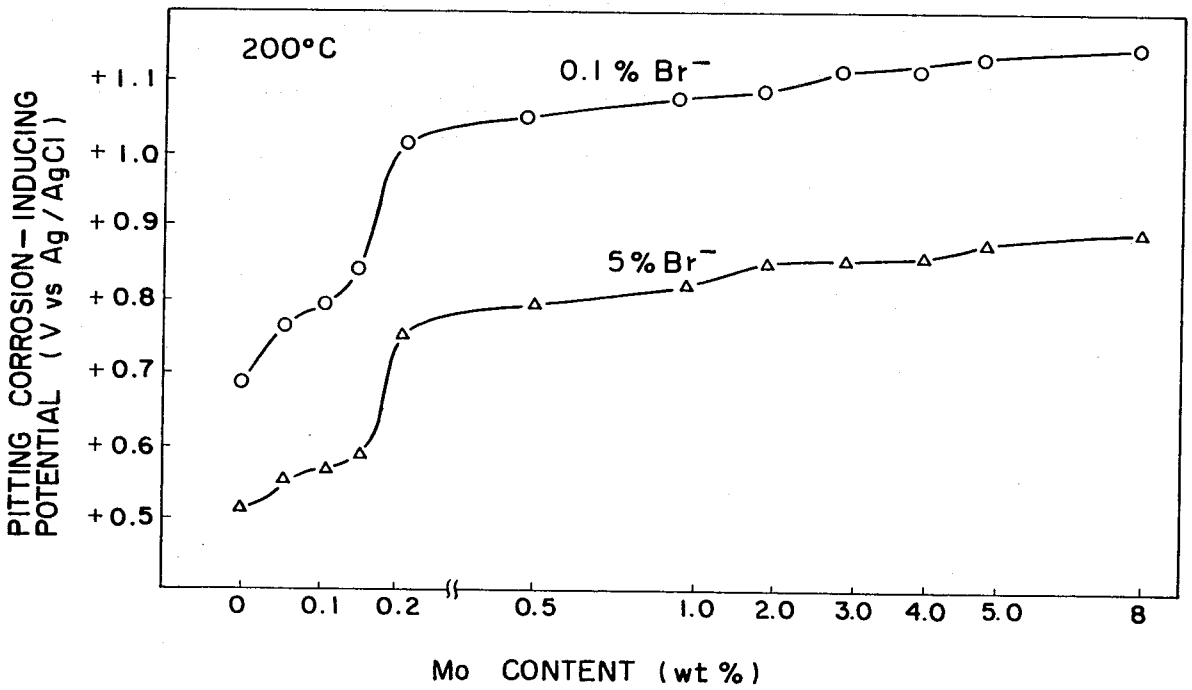
FIG. 1 is a graph showing the relationship between the Mo content in the Ti-Mo alloy and the pitting potential.

The pitting potential was measured in the same manner as in Example 1 except that the measuring temperature was 200° C. and the concentration of bromide ions was 0.1% and 5%. As with the results shown in FIG. 1, the pitting potential remarkably increased as the Mo content exceeds 0.2%.

EXAMPLE 3

Figure 2:
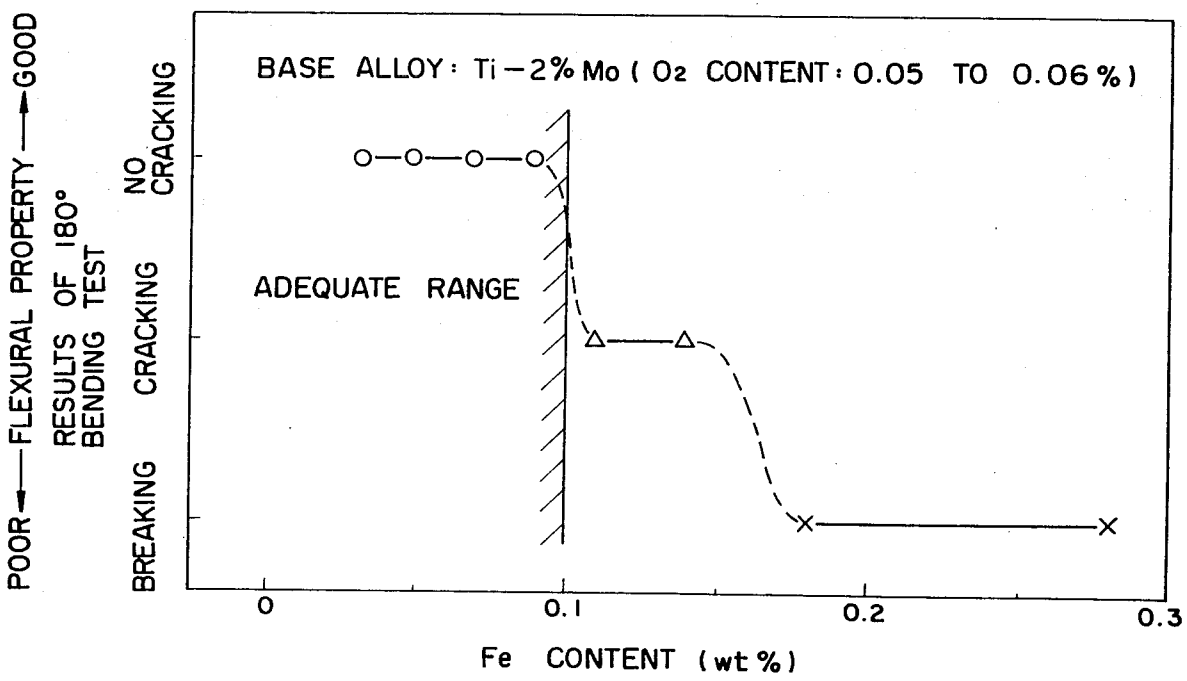
FIG. 2 is a graph showing the relationship between the flexural property and the Fe content of the Ti-2% Mo alloy.

Three kinds of titanium alloys (Ti-0.5% Mo, Ti-2% Mo, and Ti-3% Mo) each containing a different amount of Fe were prepared. (The amount of $O_2$ was kept at 0.05 to 0.06%.) Each alloy was made into a plate sample, which was then subjected to the bending test. (The plate was bent 180° around a rod having a radius which is 2.5 times the thickness of the plate.) The results are shown in Table 2. The data of the alloy containing 2% of Mo are plotted in FIG. 2. It is noted that as the Fe content exceeds 0.1%, cracking or breaking occurs in the bending test. This means that the plate is poor in formability. There was no significant difference in the pitting potential so long as the Fe content is lower than 0.1%.

TABLE 2

| Results of 180° bending test | | | |
|---|---|---|---|
| Fe content (%) | Ti—0.5% Mo | Ti—2% Mo | Ti—3% Mo |
| 0.03 | o | o | o |
| 0.05 | o | o | o |
| 0.07 | o | o | o |
| 0.09 | o | o | o |
| 0.11 | Δ | Δ | Δ |
| 0.14 | Δ | Δ | x |
| 0.18 | x | x | x |
| 0.28 | x | x | x |

o Bending with no cracking.
Δ Cracking at the top of the bend.
x Breaking before 180° bending.

EXAMPLE 4

Figure 3:
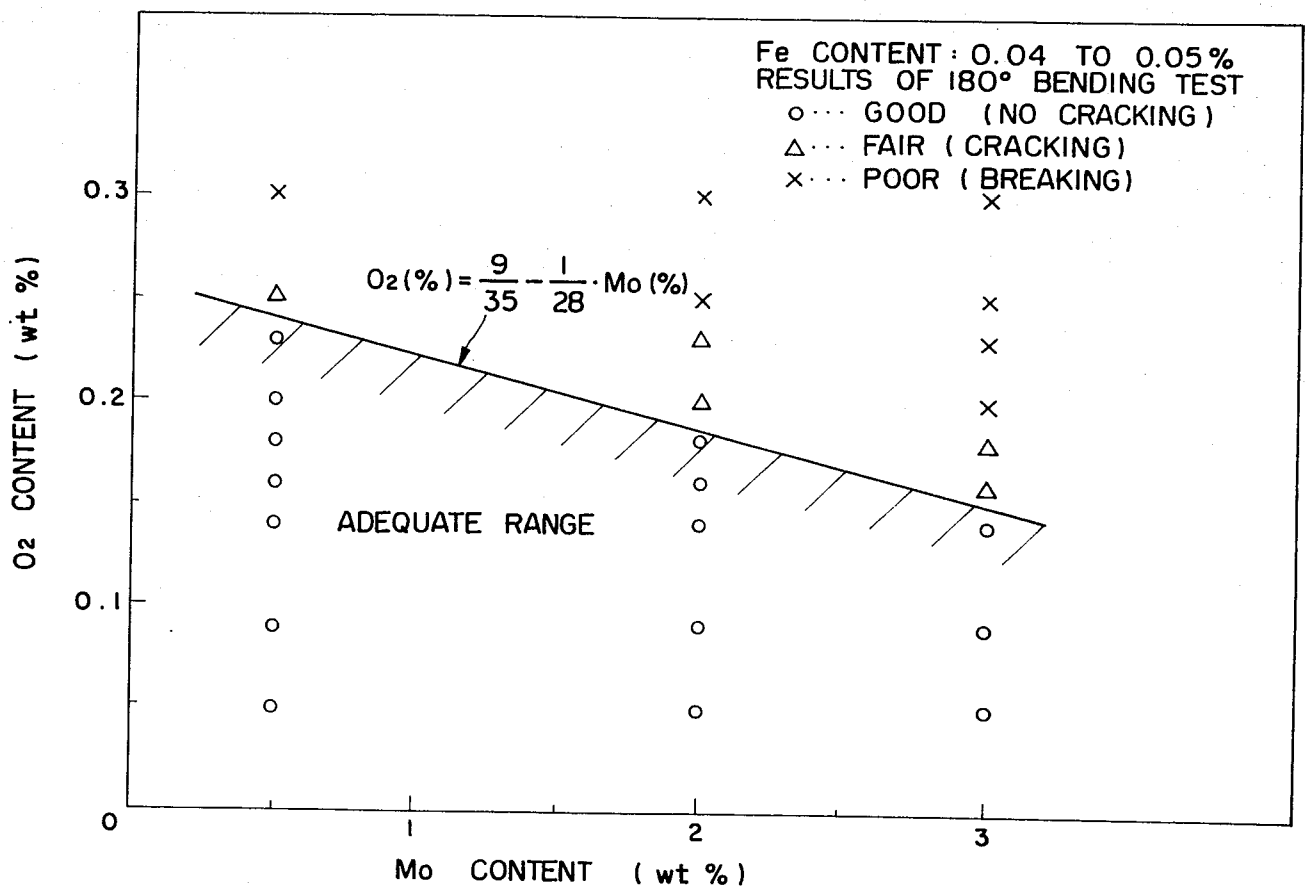
FIG. 3 is a graph showing the relationship between the amount of $O_2$ (upper limit) and the amount of Mo and also showing the adequate area for good flexural property of Ti-Mo alloy.

Three kinds of titanium alloys (Ti-0.5% Mo, Ti-2% Mo, and Ti-3% Mo) each containing a different amount of $O_2$ were prepared. (The amount of Fe was kept at 0.04 to 0.05%.) Each alloy was made into a plate sample, which was then subjected to the bending test in the same manner as in Example 3. The results are shown in Table 3. It is noted that as the $O_2$ content increases, the plate becomes poor in flexural performance. The upper limit of $O_2$ content varies depending on the amount of Mo. (The higher the amount of Mo, the lower the upper limit.) As shown in FIG. 3, there is a linear relationship between the upper limit of $O_2$ content and the amount of Mo. In order for the alloy to have satisfactory formability, it is necessary that the $O_2$ content should be within the specified area. There was no significant difference in the pitting potential so long as the $O_2$ content is within the area and the effect of Mo is predominant.

TABLE 3

| | Results of 180° bending test | | |
|---|---|---|---|
| $O_2$ content (%) | Ti—0.5% Mo | Ti—2% Mo | Ti—3% Mo |
| 0.05 | o | o | o |
| 0.09 | o | o | o |
| 0.14 | o | o | o |
| 0.16 | o | o | Δ |
| 0.18 | o | o | Δ |
| 0.20 | o | Δ | x |
| 0.23 | o | Δ | x |
| 0.25 | Δ | x | x |
| 0.30 | x | x | x |

o Bending with no cracking.
Δ Cracking at the top of the bend.
x Breaking before 180° bending.

EXAMPLE 5

Figure 4:
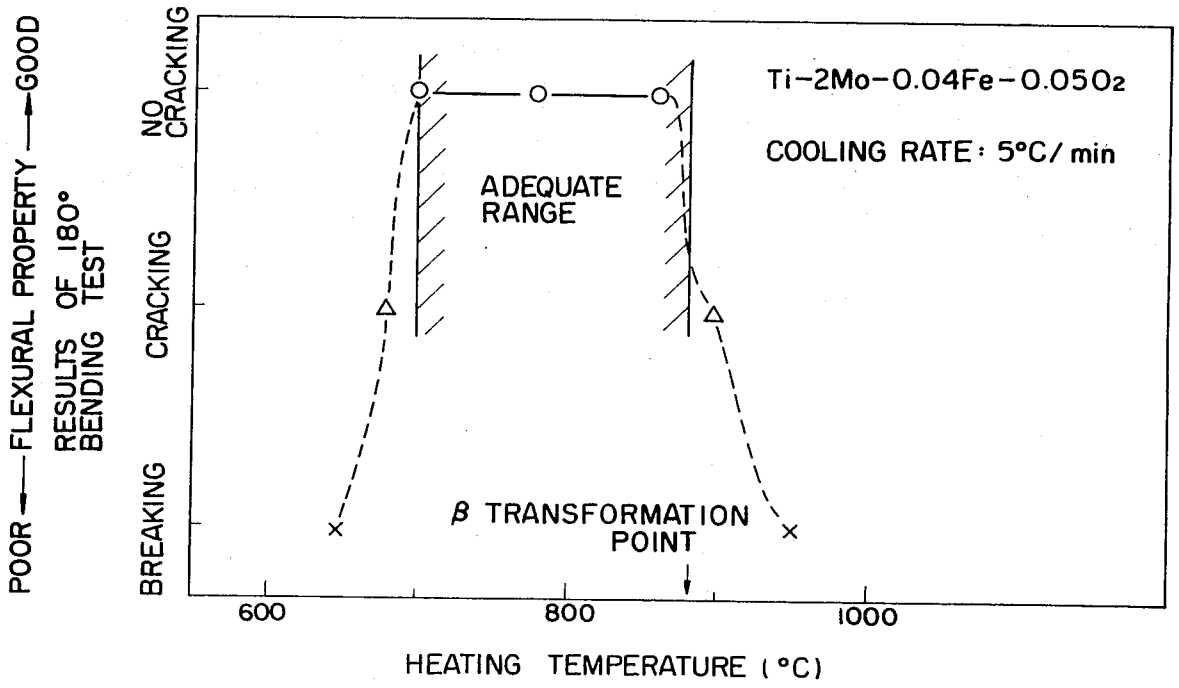
FIG. 4 is a graph showing the relationship between the flexural property and the annealing temperature.
Figure 5:
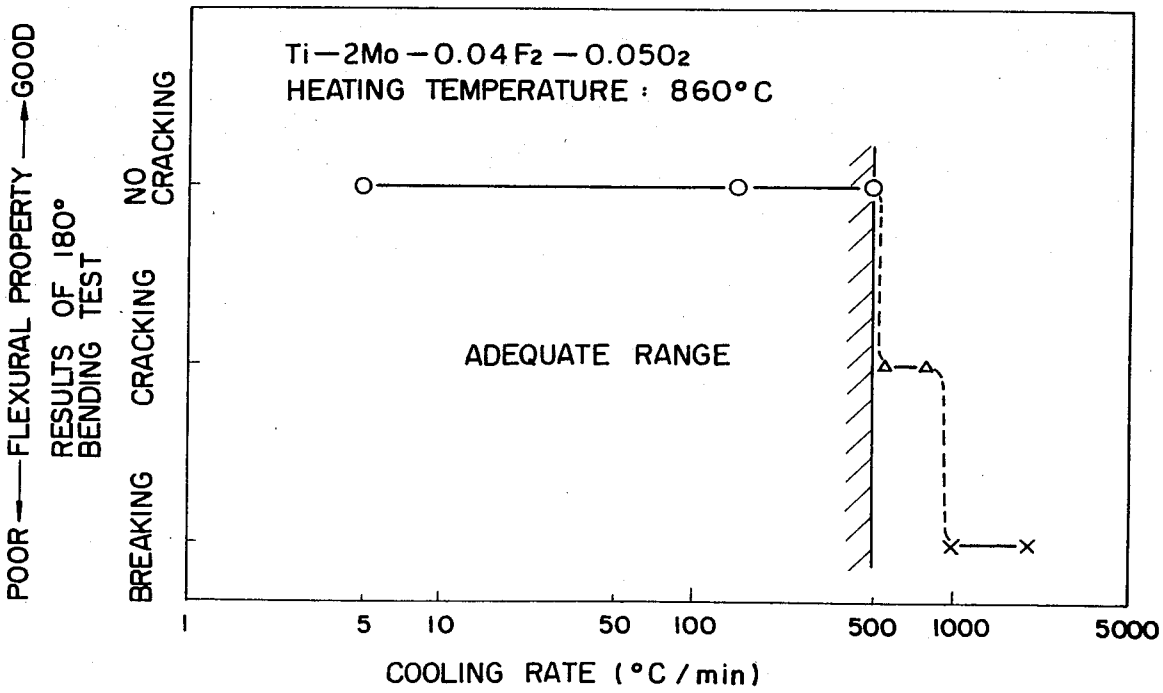
FIG. 5 is a graph showing the relationship between the flexural property and the cooling rate.

An alloy of Ti-2% Mo-0.04% Fe-0.05% $O_2$ ($\beta$-transformation point: 882° C.) was made into plate by cold rolling, and the plate was annealed under different conditions (temperature and cooling rate). The annealed plate was subjected to the 180° bending test. For comparison, three alloys containing Fe and/or $O_2$ in an amount outside the prescribed range were tested in the same manner. The results are shown in Table 4. The relationship between the heating temperature and the flexural properties is plotted in FIG. 4, and the relationship between the cooling rate and the flexural properties is plotted in FIG. 5. It is apparently noted that the good flexural properties are obtained when the heating temperature and the cooling rate are adequate. However, this does not apply where the content of Fe and/or $O_2$ is outside the prescribed range.

It was confirmed that the pitting potential is not affected by the annealing conditions so long as the composition of the alloy is within the specified range.

TABLE 4

| | | Results of 180° bending test | | |
|---|---|---|---|---|
| No. | Alloy composition (%) | Heating temp. (°C.) | Cooling rate (°C./min) | 180° bending test |
| 1 | Ti—2Mo—0.04Fe—0.05$O_2$ | 650 | 5 | x |

TABLE 4-continued

| | | Results of 180° bending test | | |
|---|---|---|---|---|
| No. | Alloy composition (%) | Heating temp. (°C.) | Cooling rate (°C./min) | 180° bending test |
| 2 | " | 680 | 5 | Δ |
| 3 | " | 700 | 5 | o |
| 4 | " | 700 | 150 | o |
| 5 | " | 700 | 450 | o |
| 6 | " | 700 | 500 | o |
| 7 | " | 700 | 550 | Δ |
| 8 | " | 700 | 800 | x |
| 9 | " | 700 | 1000 | x |
| 10 | " | 780 | 5 | o |
| 11 | " | 780 | 150 | o |
| 12 | " | 780 | 500 | o |
| 13 | " | 780 | 550 | Δ |
| 14 | " | 780 | 1000 | x |
| 15 | " | 860 | 5 | o |
| 16 | " | 860 | 150 | o |
| 17 | " | 860 | 500 | o |
| 18 | " | 860 | 550 | Δ |
| 19 | " | 860 | 800 | Δ |
| 20 | " | 860 | 1000 | x |
| 21 | " | 860 | 2000 | x |
| 22 | " | 900 | 5 | Δ |
| 23 | " | 900 | 150 | x |
| 24 | " | 900 | 500 | x |
| 25 | " | 900 | 1000 | x |
| 26 | " | 950 | 5 | x |
| 27 | " | 950 | 500 | x |
| 28 | Ti—2Mo—0.18Fe—0.05$O_2$ | 780 | 5 | Δ |
| 29 | Ti—2Mo—0.05Fe—0.23$O_2$ | 780 | 5 | Δ |
| 30 | Ti—2Mo—0.14Fe—0.20$O_2$ | 780 | 5 | x |

o Bending with no cracking.
Δ Cracking at the top of the bend.
x Breaking before 180° bending.

As mentioned above, the titanium alloy of this invention is greatly improved in resistance to pitting corrosion that takes place in an environment of bromide ions, owing to a specified amount of molybdenum added thereto. In addition, with the upper limits of Fe and $O_2$ content specified, the titanium alloy is improved in formability without adverse effect on the resistance to pitting corrosion.

What is claimed is:

1. A Ti-Mo alloy consisting essentially of 0.2 to 3.0 wt % of molybdenum, with the balance being substantially titanium, characterized in that the amount of Fe in the impurities is not greater than 0.1% and the amount of $O_2$ in the impurities is in the range that satisfies the following equation on the basis of the amount of Mo (%).

$$O_2\,(\%) \leqq 9/35 - 1/28 \cdot Mo\,(\%)$$

said titanium alloy having been heated at a temperature higher than 700° C. and lower than the $\beta$-transformation point and then cooled at a rate of 500° C./min or less whereby an alloy is obtained highly reistant to pitting corrosion in an environment where there are bromide ions and which is malleable and superior in formability.

* * * * *